US007313901B2

(12) United States Patent
Kakita et al.

(10) Patent No.: US 7,313,901 B2
(45) Date of Patent: Jan. 1, 2008

(54) PACKAGING APPARATUS, PACKAGING METHOD, PACKAGING SYSTEM

(75) Inventors: Yukio Kakita, Ritto (JP); Yukio Nakagawa, Ritto (JP); Akira Asahina, Kyoto (JP)

(73) Assignee: Ishida Co., Ltd., Kyoto (JP)

( * ) Notice: Subject to any disclaimer, the term of this patent is extended or adjusted under 35 U.S.C. 154(b) by 1 day.

(21) Appl. No.: 10/522,612

(22) PCT Filed: Jul. 28, 2003

(86) PCT No.: PCT/JP03/09558

§ 371 (c)(1),
(2), (4) Date: Jul. 14, 2005

(87) PCT Pub. No.: WO2004/011334

PCT Pub. Date: Feb. 5, 2004

(65) Prior Publication Data

US 2006/0162290 A1 Jul. 27, 2006

(30) Foreign Application Priority Data

Jul. 30, 2002 (JP) ..... 2002-221187

(51) Int. Cl.
*B65B 31/02* (2006.01)

(52) U.S. Cl. ..... 53/434; 53/79; 53/403; 53/451

(58) Field of Classification Search ..... 53/79, 53/403, 428, 432, 434, 451, 551, 554, 555
See application file for complete search history.

(56) References Cited

U.S. PATENT DOCUMENTS

| | | | | |
|---|---|---|---|---|
| 5,546,733 | A * | 8/1996 | Paltrinieri | 53/503 |
| 6,684,609 | B1 * | 2/2004 | Bassissi et al. | 53/503 |
| 6,729,108 | B2 * | 5/2004 | Tsuruta | 53/451 |
| 6,843,037 | B2 * | 1/2005 | Nolfi, Jr. | 53/127 |

FOREIGN PATENT DOCUMENTS

| | | | |
|---|---|---|---|
| JP | S64-084831 | A | 3/1989 |
| JP | 04-072160 | A | 3/1992 |
| JP | 08-040424 | A | 2/1996 |
| JP | 11-171110 | A | 6/1999 |
| JP | 2000-289717 | A | 10/2000 |
| JP | 2001-165803 | A | 6/2001 |
| JP | 2002-211521 | A | 7/2002 |
| KR | 2000-0073275 | A | 12/2000 |

* cited by examiner

*Primary Examiner*—Hemant M. Desai
(74) *Attorney, Agent, or Firm*—Global IP Counselors, LLP

(57) ABSTRACT

The present invention provides a packaging apparatus (1) capable of adjusting the thickness of a package with a simple configuration. The packaging apparatus (1) is a packaging apparatus that manufactures a package (B) wherein articles to be packaged, such as foodstuffs, and gas are sealed in a bag, and comprises a cooling unit (6). The cooling unit (6) cools the gas sent to a tubular film (F) formed in a bag shape. The packaging apparatus (1) manufactures the package (B) wherein the gas, having a temperature lower than the outside air, and the articles to be packaged are sealed.

15 Claims, 9 Drawing Sheets

PACKAGING APPARATUS, PACKAGING METHOD, PACKAGING SYSTEM

This application is the National Phase of International Application PCT/JP03/09558 filed on Jul. 28, 2003.

FIELD OF THE INVENTION

The present invention relates to a packaging apparatus, a packaging method, and a packaging system.

RELATED ART

There are packaging apparatuses that fill and package articles to be packaged, such as foodstuffs, in flexible packaging material. For example, in a vertical pillow-type packaging apparatus, a former tubularly forms flexible packaging material, such as sheet film, and a longitudinal sealing mechanism seals (thermoseals) the overlapping vertical edges of the tubular packaging material. Furthermore, articles to be packaged are fed into the tubular packaging material through a tube, a transverse sealing mechanism arranged below the tube transversely seals across the upper part of the bag and the lower part of the following bag, after which a cutter cuts the center of the transverse seal portion. In this manner, the vertical pillow-type packaging apparatus manufactures a package wherein the articles to be packaged are sealed.

In such a packaging apparatus, there are cases in which the package is filled with gas, such as nitrogen or argon, along with the articles to be packaged in order to preserve the articles to be packaged. Furthermore, in such a case, the thickness of the package is often adjusted from a standpoint of convenience when packing the packages in boxes. For example, the packaging apparatus disclosed in Japanese Published Patent Application No. Hei 11-171110 is provided with an air bleeder plate, and the thickness of the package being manufactured is adjusted by the air bleeder plate removing a portion of the gas by pressing on both sides of the packaging material.

DISCLOSURE OF THE INVENTION

However, in the abovementioned type of packaging apparatus, a mechanism is needed to remove the gas, such as a mechanism that adjusts the position of the air bleeder plate and the air bleeder plate. Consequently, this tends to further complicate the structure of the packaging apparatus.

It is an object of the present invention to provide a packaging apparatus that, with a simple configuration, can adjust the thickness of a package.

The packaging apparatus as recited in the first aspect of the present invention is a packaging apparatus that manufactures a package wherein a foodstuff article to be packaged and an inert gas are sealed in a packaging material. The packaging apparatus includes an introducing unit through which the article to be packaged and the gas are supplied to the packaging material formed in a tubular shape, and a first sealing mechanism that seals the tubular packaging material to manufacture a package containing the article and the gas. The package is manufactured in which a gas has a temperature lower than the outside air, when the gas and the article to be packaged are sealed.

In this packaging apparatus, a package is manufactured wherein a gas having a temperature different from the outside air and articles to be packaged are sealed. Consequently, the thickness of the package can be adjusted by expanding or shrinking the sealed air, which is affected by the temperature of the outside air. For example, if the temperature of the sealed gas is lower than the outside air, the temperature of the gas rises with the passage of time. Furthermore, the thickness of the package can be increased by expanding the gas. Conversely, if the temperature of the sealed gas is higher than the outside air, the temperature of the gas falls with the passage of time. Furthermore, the thickness of the package can be decreased by reducing the volume of the gas. Thus, according to this packaging apparatus, the thickness of a package can be adjusted by adjusting the temperature of the sealed gas. Thereby, according to this packaging apparatus, the thickness of the bag can be adjusted with a simple configuration.

Furthermore, the means for making the temperature of the sealed gas a temperature that differs from the outside air is not limited to a means wherein the temperature of the sealed gas is directly adjusted to a temperature that differs from the outside air, and includes a means that indirectly adjusts the temperature of the gas by transmitting to the sealed gas the temperature of the flexible packaging material, the article to be packaged, and the like, by adjusting that temperature.

The packaging apparatus as recited in the second aspect of the present invention is the packaging apparatus as recited in the first aspect of the present invention, comprising a gas temperature modifying unit that changes a temperature of a gas.

In this packaging apparatus, a package can be manufactured, wherein a gas having a temperature different from the outside air is sealed, by the gas temperature modifying unit changing the temperature of the gas. Consequently, the thickness of the package can be adjusted by expanding or shrinking the sealed gas, which is affected by the temperature of the outside air. Thereby, according to this packaging apparatus, the thickness of the bag can be adjusted with a simple configuration for changing the temperature of the gas.

The packaging apparatus as recited in the third aspect of the present invention is the packaging apparatus as recited in the second aspect of the present invention, in which the gas temperature modifying unit changes the temperature of the gas by changing the temperature of the article to be packaged.

In this packaging apparatus, the temperature of the gas can be indirectly changed by changing the temperature of the articles to be packaged, which are the target objects to be packaged. For example, if the articles to be packaged are cooled and sealed together with the gas, then the gas, which is affected by the temperature of the articles to be packaged, is cooled. Furthermore, the thickness of the package decreases because the volume of the cooled gas decreases. Thus, according to this packaging apparatus, the thickness of the package can be adjusted with a simple configuration for changing the temperature of the articles to be packaged.

The packaging apparatus as recited in the fourth aspect of the present invention is the packaging apparatus as recited in the second aspect of the present invention, in which the gas temperature modifying unit changes the temperature of the gas by changing the temperature of the flexible packaging material.

In this packaging apparatus, the temperature of the gas can be indirectly changed by changing the temperature of the flexible packaging material. For example, if the flexible packaging material is cooled, then the internally sealed gas, which is affected by the temperature of the flexible packaging material, is cooled. Therefore, the thickness of the package decreases because the volume of the cooled gas decreases. Thus, the thickness of the package can be adjusted with a simple configuration for changing the temperature of the flexible packaging material.

The packaging apparatus as recited in the fifth aspect of the present invention is the packaging apparatus as recited in the second aspect of the present invention, in which the gas temperature modifying unit changes the temperature of the gas by changing the temperature of the introducing unit.

In this packaging apparatus, the gas temperature modifying unit changes the temperature of the introducing unit. Because the gas is introduced inside the flexible packaging material by the introducing unit, the temperature of the gas, which is affected by the temperature of the introducing unit when introduced, changes. Thereby, this packaging apparatus can manufacture a package wherein a gas having a temperature different from the outside air is sealed.

The packaging apparatus as recited in the sixth aspect of the present invention is the packaging apparatus as recited in the first aspect of the present invention, comprising a forming unit and a gas temperature modifying unit. The forming unit tubularly forms the flexible packaging material. The gas temperature modifying unit changes the temperature of the gas by changing the temperature of the forming unit.

In this packaging apparatus, the gas temperature modifying unit changes the temperature of the forming unit. Because the gas is introduced inside the flexible packaging material by the forming unit, the temperature of the gas, which is affected by the temperature of the forming unit, changes if the temperature of the forming unit changes. Thereby, this packaging apparatus can manufacture a package wherein a gas having a temperature different from the outside air is sealed.

The packaging apparatus as recited in the seventh aspect of the present invention is the packaging apparatus as recited in any one of the first through sixth aspects of the present invention, further comprising a control unit that controls the temperature and amount of the gas in the sealed package.

In this packaging apparatus, the control unit controls the temperature and quantity of the gas sealed in the package. Consequently, according to this packaging apparatus, the volume of the gas after expansion or shrinkage can be automatically regulated. Thereby, this packaging apparatus can automatically adjust the thickness of the package.

The packaging apparatus as recited in the eighth aspect of the present invention is the packaging apparatus as recited in any one of the first through seventh aspects of the present invention, wherein the gas sealed inside the sealed package has a temperature lower than that of the outside air.

In packaging apparatuses, it is often the case that a package is manufactured leaving some margin in the inflation of the package, without inflating the package to its maximum during its manufacture. This is because it is easier to manufacture a package if some margin is allowed in the inflation of the package. On the other hand, if some margin is allowed in the inflation of the package, there is a problem in that the inflation of the completed package is inadequate.

However, in this packaging apparatus, the gas sealed in the flexible packaging material has a temperature lower than the outside air, and the temperature thereof consequently rises and the package expands with the passage of time. Consequently, even if a small margin is allowed in the inflation of the package during its manufacture, the package can be adequately inflated by expanding the gas inside the package after it is completed. Thereby, according to this packaging apparatus, the package can be adequately inflated after manufacture while still making the package easy to manufacture.

The packaging apparatus as recited in the ninth aspect of the present invention is the packaging apparatus as recited in the first aspect of the present invention, further comprising a sealing unit and a pair of ironing parts. The sealing unit hermetically seals the flexible packaging material by sealing the flexible packaging material tubularly formed. The pair of ironing parts irons the portion of the packaging material to be sealed, and the vicinity thereof.

In the packaging apparatus comprising ironing parts, the unfortunate entangling of the articles to be packaged and the like in the portion to be sealed can be reduced by ironing the portion of the flexible packaging material to be sealed, etc. However, in this case, because a portion of the gas in the flexible packaging material unfortunately escapes due to the ironing, it is often problematic to adequately inflate the package.

However, in this packaging apparatus, because a package sealed with a gas having a temperature lower than the outside air is manufactured, the gas inside the package after manufacture expands, and the package can be adequately inflated even if a portion of the gas escapes due to the ironing. Thereby, in this packaging apparatus, the package can be adequately inflated while reducing the incidence of unfortunate entangling of the articles to be packaged and the like in the portion to be sealed, and the like.

The packaging apparatus as recited in the tenth aspect of the present invention is the packaging apparatus as recited in the first aspect of the present invention, further comprising a transporting unit and a second sealing unit. The transporting unit transports the flexible packaging material tubularly formed downward. The second sealing unit seals a longitudinal edge, parallel to the transport direction, of the transported tubular packaging material. The first sealing unit seals the flexible packaging material in the transverse direction, which is perpendicular to the transport direction.

The packaging method as recited in the eleventh aspect of the present invention is a packaging method for manufacturing a package wherein articles to be packaged and a gas are sealed in a flexible packaging material, including steps of providing a tubular packaging material, supplying the article to be packaged in the tubular packaging material, supplying the gas in the tubular packaging material, sealing the tubular packaging material to manufacture a package containing the article and the gas, and changing a temperature of the gas before or after the supplying of the gas in the tubular packaging material, such that the gas has a temperature different from the outside air, when the gas and the article to be packaged are sealed.

In this packaging method, a package is manufactured wherein a gas having a temperature different from the outside air and the articles to be packaged are sealed. Consequently, the thickness of the package can be adjusted by expanding or shrinking the sealed gas, which is affected by the temperature of the outside air. For example, if the temperature of the sealed gas is lower than the outside air, the temperature of the gas rises with the passage of time. Furthermore, the thickness of the package can be increased by expanding the gas. Conversely, if the temperature of the sealed gas is higher than the outside air, then the temperature of the gas falls with the passage of time. Furthermore, the thickness of the package can be decreased by decreasing the volume of the gas. Thus, according to this packaging method, the thickness of the package can be adjusted by adjusting the temperature of the sealed gas. Thereby, according to this packaging method, the thickness of a bag can be adjusted with a simple configuration. Furthermore, the means for making the temperature of the sealed gas a temperature different than the outside air is not limited to directly adjusting the temperature of the sealed gas to a temperature different from the outside air, and may include indirectly adjusting the temperature of the gas by transmitting to the sealed gas the temperature of the flexible packaging material, the article to be packaged, and the like, by adjusting that temperature.

A packaging system as recited in the twelfth aspect of the present invention comprises a packaging apparatus, and a gas temperature modifying unit. The packaging apparatus manufactures a package wherein a foodstuff article to be packaged and an inert gas are sealed in a flexible packaging material. The packaging apparatus includes an introducing unit through which the article to be packaged and the gas are supplied to the packaging material formed in a tubular shape; and a first sealing mechanism that seals the tubular packaging material to produce a package containing the article and the gas. The gas temperature modifying unit changes the temperature of the gas before the gas is sealed in the package. Further, the packaging apparatus manufactures the package wherein the gas having a temperature lower than that of the outside air, and the article to be packaged are sealed.

In this packaging system, a package is manufactured wherein a gas having a temperature different from the outside air and the articles to be packaged are sealed. Consequently, the thickness of the package can be adjusted by expanding or shrinking the sealed gas, which is affected by the temperature of the outside air. For example, if the temperature of the sealed gas is lower than the outside air, the temperature of the gas rises with the passage of time. Furthermore, the thickness of the package can be increased by expanding the gas. Conversely, if the temperature of the sealed gas is higher than the outside air, the temperature of the gas falls with the passage of time. Furthermore, the thickness of the package can be decreased by decreasing the volume of the gas. Furthermore, according to this packaging system, the thickness of the package can be adjusted by adjusting the temperature of the sealed gas. Thereby, according to this packaging system, the thickness of a bag can be adjusted with a simple configuration.

Furthermore, the gas temperature modifying unit that adjusts the temperature of the gas before it is sealed in the package is not limited to a means that directly adjusts the temperature of the sealed gas to a temperature different from the outside air, and also includes a means that indirectly adjusts the temperature of the gas by transmitting to the sealed gas the temperature of the flexible packaging material, the article to be packaged, and the like, by adjusting that temperature.

The packaging system as recited in the thirteenth aspect of the present invention is the packaging system as recited in the twelfth aspect of the present invention, further comprising a thermal application unit. The thermal application unit performs thermal application processing on the manufactured package.

In this packaging system, the package can be inflated in a relatively short time by applying heat to a package in which cool air has been blown during manufacture of the bag.

The packaging system as recited in the fourteenth aspect of the present invention is the packaging system as recited in the thirteenth aspect of the present invention, wherein the thermal application unit has a thermostatic chamber that warms the package.

In this packaging system, the package can be inflated by raising the temperature of the gas inside the package by passing through the thermostatic chamber the package that exits the packaging apparatus.

The packaging system as recited in the fifteenth aspect of the present invention is the packaging system as recited in the thirteenth aspect, wherein the thermal application unit blows hot air onto the package.

In this packaging system, the thermal application unit blows hot air against the package, and the package can therefore be easily inflated by raising the temperature of the gas inside the package.

The packaging system as recited in the sixteenth aspect of the present invention is the packaging system as recited in any one of the thirteenth through fifteenth aspects of the present invention, further comprising a postprocessing checking apparatus that performs postprocessing checking of the package.

In this packaging system, a postprocessing apparatus is disposed that performs postprocessing of the package; however, because the packages generally are reliably inflated to a desired state by the thermal application unit, processing in the postprocessing apparatus is facilitated. For example, if the postprocessing apparatus is a seal checker that inspects whether the seal in the packaging apparatus passes or fails, then the package transits to an adequately inflated state due to the thermal application unit by the time the package is transported to the seal checker; consequently, it is possible with the seal checker to always perform inspection of the package in an inflated state. Thus, the efficiency of the postprocessing apparatus can be improved, and it is therefore also possible to improve the operating ratio of the entire packaging system.

The packaging system as recited in the seventeenth aspect of the present invention is the packaging system as recited in the sixteenth aspect, further comprising a control unit. The control unit controls the gas temperature modifying unit based on detection information produced by the postprocessing checking apparatus.

In this packaging system, the detection information and the postprocessing apparatus is sent to the control unit, and the control unit controls the gas temperature modifying unit based on this detection information. Thereby, the gas temperature modifying unit can do things so that gas of an optimal temperature is sealed in the package, making it easy to perform processing in the postprocessing apparatus.

The packaging system as recited in the eighteenth aspect of the present invention is the packaging system as recited in the sixteenth aspect, further comprising the control unit. The control unit controls the thermal application unit based on detection information produced by in the postprocessing checking apparatus.

In this packaging system, the detection information in the postprocessing apparatus is sent to the control unit, and the control unit controls the thermal application unit based on this detection information. Thereby, the thermal application unit can apply heat of an optimal temperature to the package, making processing in the postprocessing apparatus easier to perform.

PREFERRED EMBODIMENTS

First Embodiment

Figure 1:
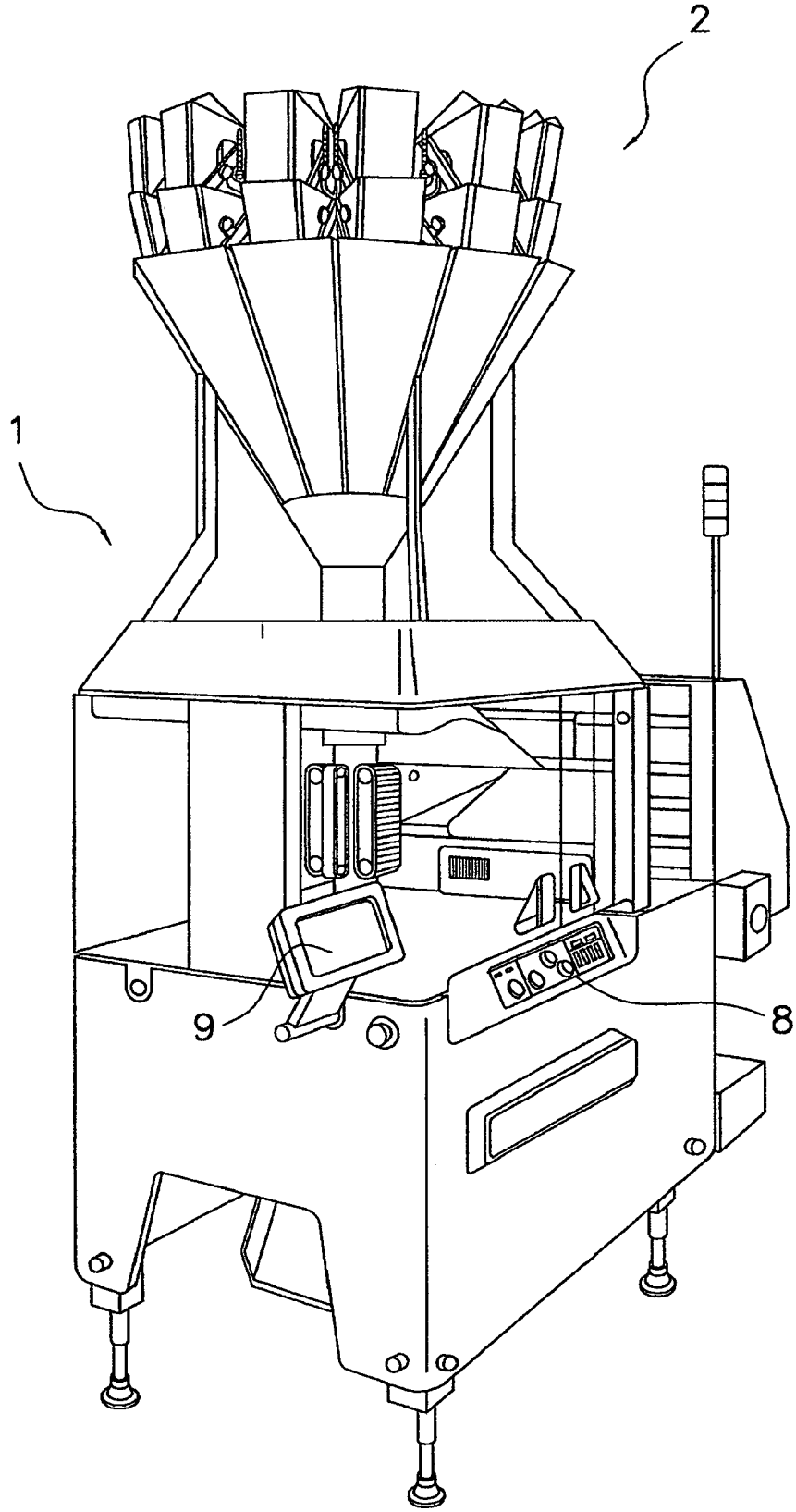
FIG. 1 is an exterior view of the vertical bag manufacturing and packaging apparatus.

FIG. 1 depicts an exterior view of a vertical bag manufacturing and packaging apparatus 1 according to one embodiment of the present invention. This vertical bag manufacturing and packaging apparatus 1 is an apparatus that manufactures a product wherein foodstuffs (e.g., potato chips) are sealed in a bag together with an inert gas, such as nitrogen or argon. The vertical bag manufacturing and packaging apparatus 1 manufactures a product by packing a bag with foodstuffs and the like together with an inert gas and the like, while manufacturing the bag from a film, and then sealing the bag. Furthermore, the foodstuffs and the like drop down after being weighed in a weighing apparatus 2 provided above the vertical bag manufacturing and packaging apparatus 1.

Figure 2:
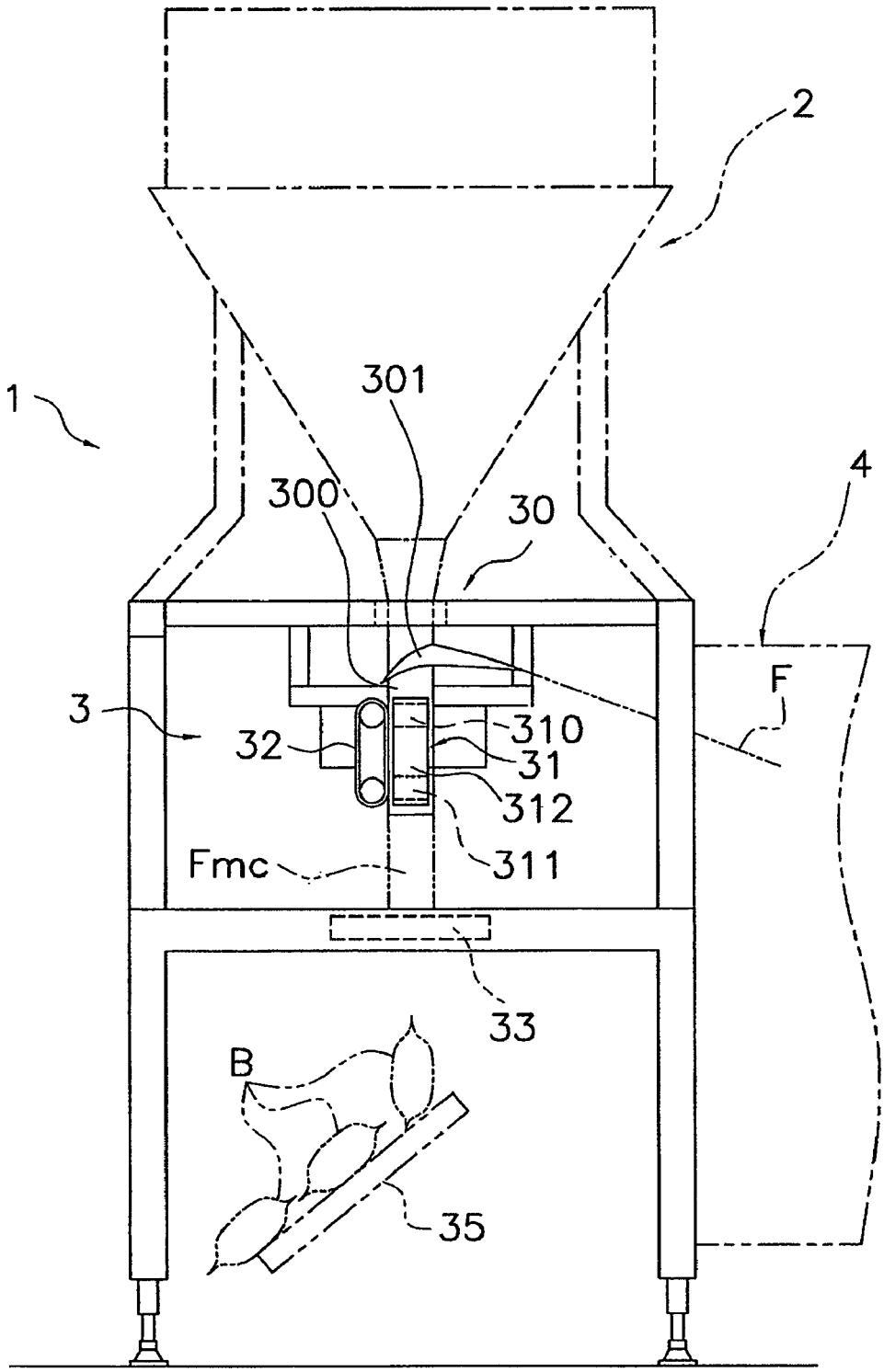
FIG. 2 is a configuration diagram of the vertical bag manufacturing and packaging apparatus.

FIG. 2 depicts the constitution of the vertical bag manufacturing and packaging apparatus 1. The vertical bag manufacturing and packaging apparatus 1 principally comprises a bag manufacturing and packaging unit 3, which is the main body that packs the foodstuffs and the like in a bag, a film feeder 4 that supplies this bag manufacturing and packaging unit 3 with a film F that will be turned into bags, a gas supply unit 5 (refer to FIG. 4) that supplies the gas bagged together with the foodstuffs and the like, a cooling unit 6 (refer to FIG. 4) that cools this gas, and a control unit 7 (refer to FIG. 6) that controls each part.

The film feeder 4 supplies sheet film F to a former 30 of the bag manufacturing and packaging unit 3, discussed later. A roll, whereupon the film F is rolled, is set on this film feeder 4, and the film F is paid out from this roll.

The bag manufacturing and packaging unit 3 comprises a former 30 that tubularly forms the sheet fed film F, pull down belt mechanisms 31 that transport the tubularly formed film Fmc (hereinbelow, referred to as the tubular film Fmc) downward, a longitudinal sealing mechanism 32 that longitudinally seals the overlapped portion of the tubular film Fmc, a transverse sealing mechanism 33 that closes off the upper and lower ends of the bag by transversely sealing the tubular film Fmc, a pair of ironing parts 34 (refer to FIG. 5), and a discharge chute 35.

Figure 3:
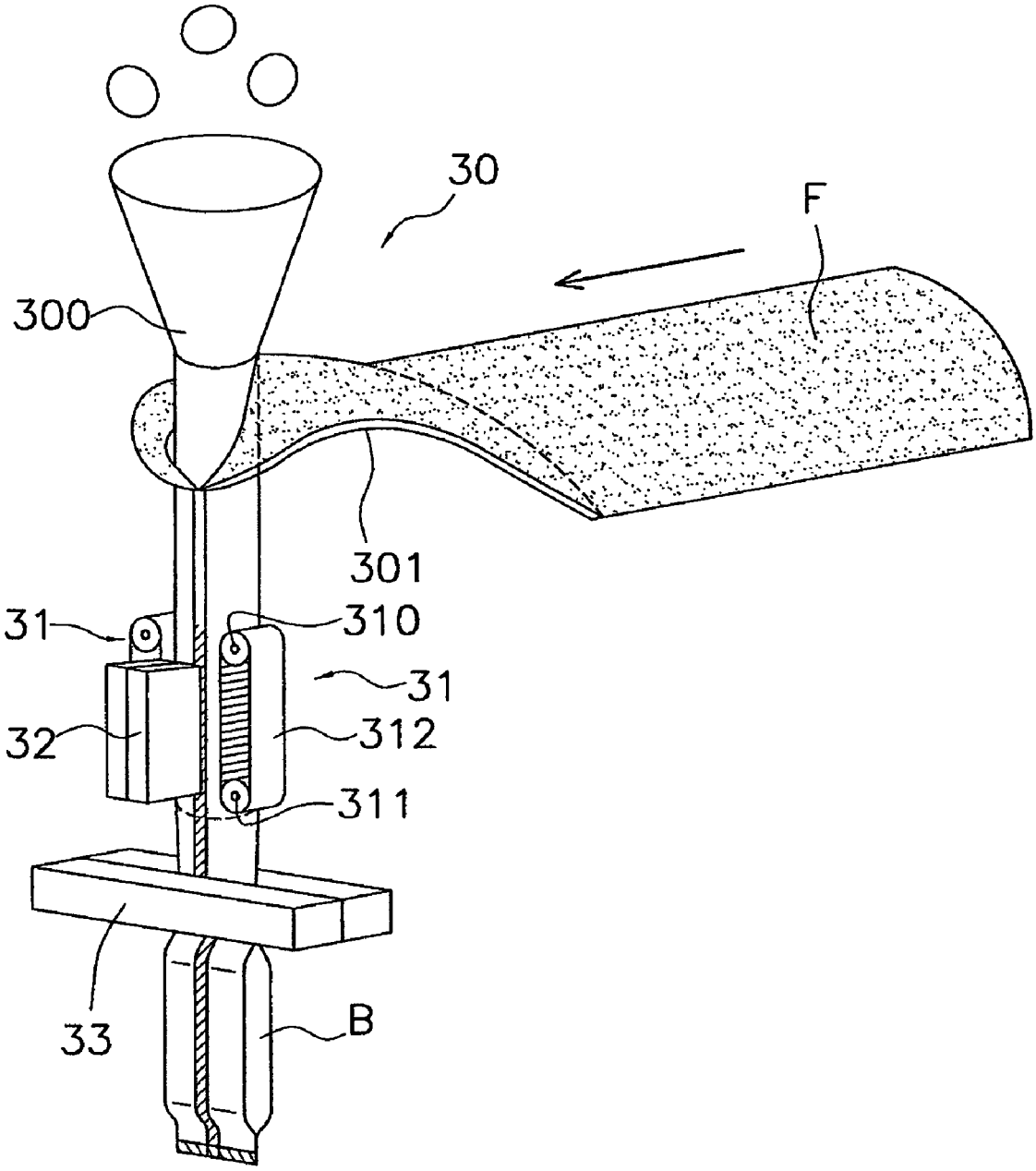
FIG. 3 is a configuration diagram of the former.

The former 30 tubularly forms the sheet fed film F, and introduces the gas, and the foodstuffs and the like inside the tubular film Fmc. The former 30 comprises a tube 300, and a shoulder 301, as shown in FIG. 3.

Figure 4:
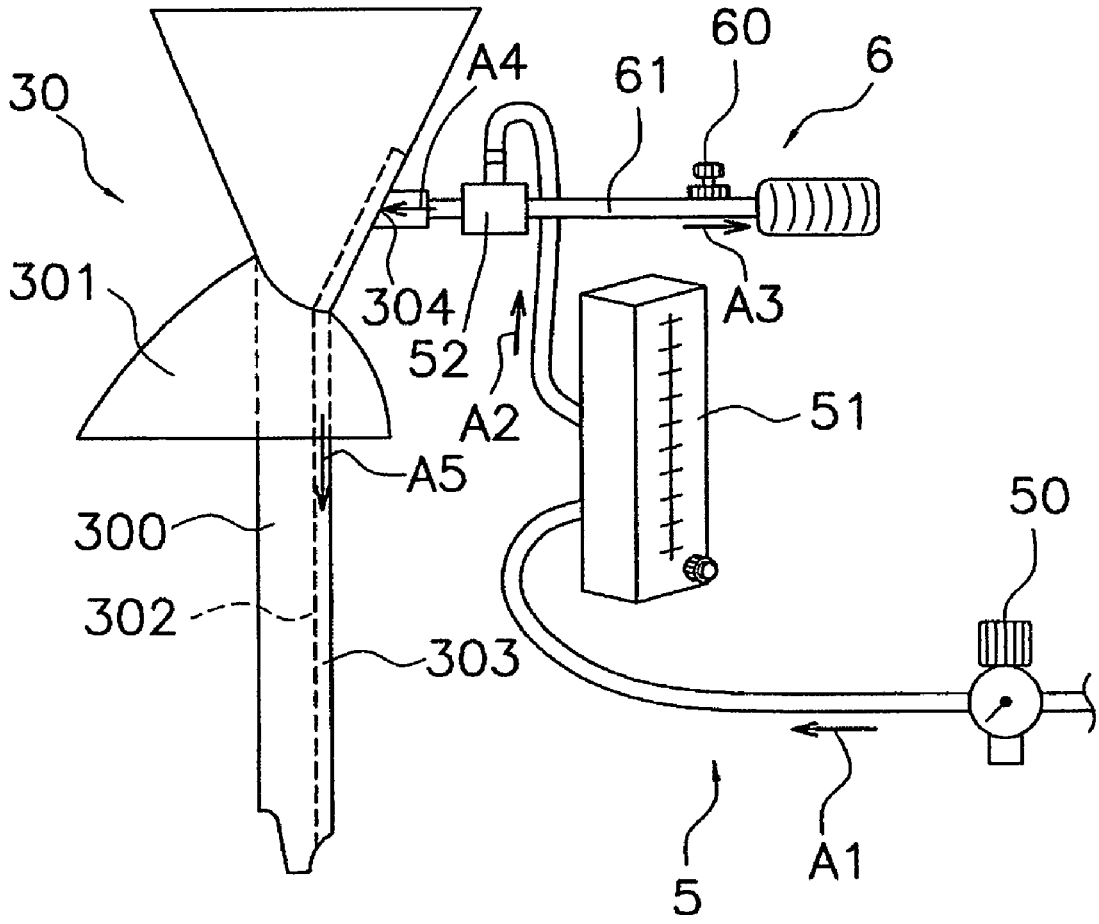
FIG. 4 is a configuration diagram of the former, a gas supply unit, and a cooling unit.

The tube 300 is a cylindrical member, open at the upper and lower ends. The tube 300 is integrated with the shoulder 301 via a bracket (not shown). Because the weighed foodstuffs and the like are fed from the weighing apparatus 2 into the upper end opening of this tube 300, the tube 300 is conical with a wider upper end opening. The lower end of the tube 300 plunges inside the film F formed in a tubular shape, and foodstuffs and the like are introduced into the film F. In addition, as shown in FIG. 4, a long plate material 302 is vertically provided on the inner side of the tube 300 spanning from the vicinity of the upper part to the lower end of the tube 300, and a gas passageway 303 is formed extending vertically between the plate material 302 and the inner surface of the tube 300. This gas passageway 303 is provided for the purpose of substituting the air inside the bag shaped film with gas. The upper end of this gas passageway 303 is closed by the bending of the plate material 302 and its connection to the inner surface of the upper part of the tube 300. In addition, at the upper part of the tube 300, an entrance 304 is formed that passes through to the upper part of the gas passageway 303, and to which a gas supply pipe is connected. The lower part of the gas passageway 303 is open and reaches the lower end of the tube 300.

The shoulder 301 is arranged so that it surrounds the tube 300. This shoulder 301 is shaped so that the sheet film F fed from the film feeder 4 is tubularly formed when it passes between the shoulder 301 and the tube 300.

The pull down belt mechanism 31 is a mechanism that applies suction to the film F wound around the tube 300, and transports the film F downward. There are two such mechanisms that interpose the tube 300, as shown in FIG. 2 and FIG. 3. The pull down belt mechanism 31 principally comprises a drive roller 310, a follower roller 311, and a belt 312 comprising a suction function.

The longitudinal sealing mechanism 32 is a mechanism that longitudinally seals the overlapping portion of the film F wound around the tube 300 by heating the portion while pressing it against the tube 300 with a constant pressure. This longitudinal sealing mechanism 32 comprises a heater (not shown), a heater belt (not shown) that is heated by the heater and contacts the overlapping portion of the film F, and the like.

Figure 5:
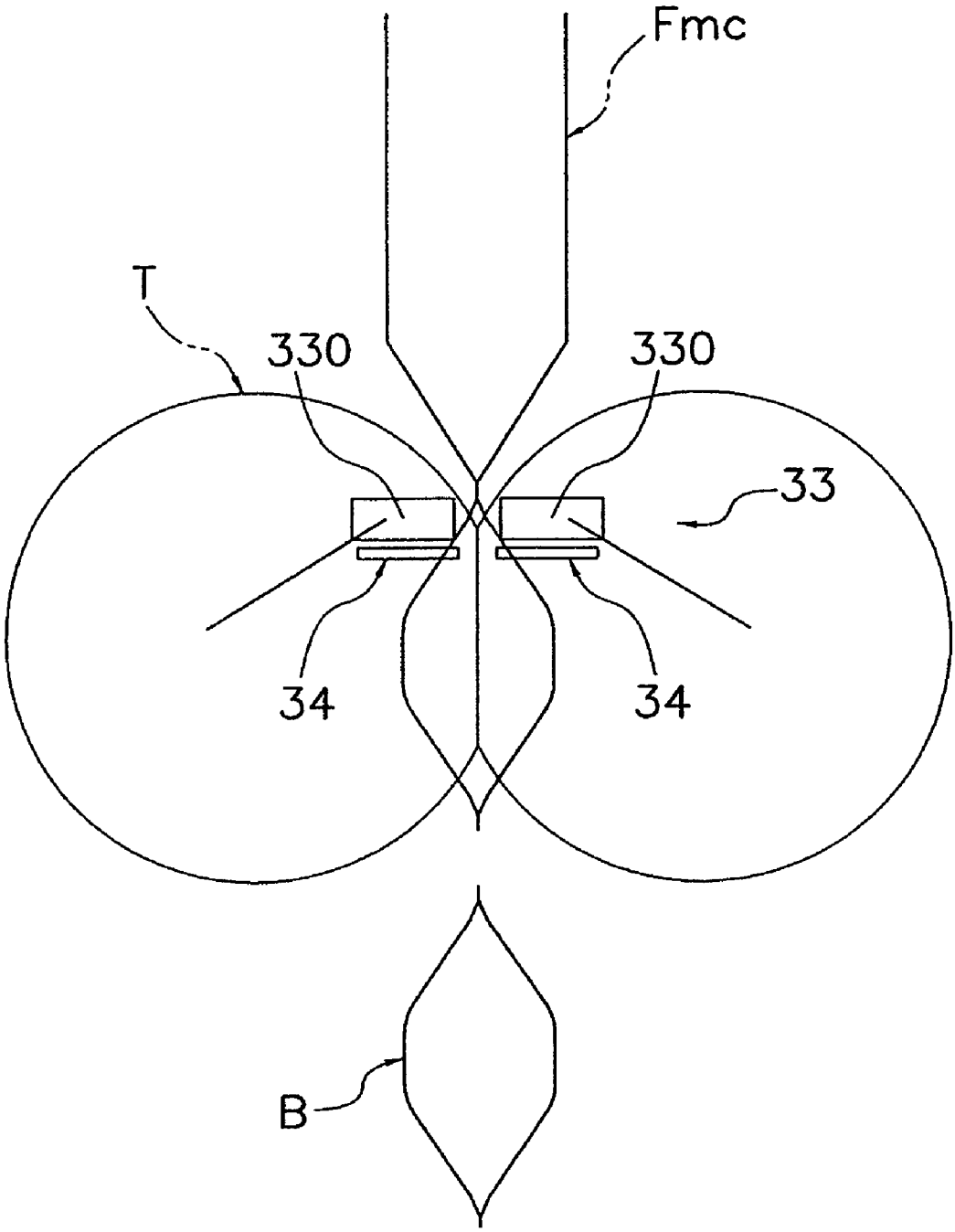
FIG. 5 illustrates a portion of the packaging operation.

The transverse sealing mechanism 33 is arranged below the former 30, the pull down belt mechanisms 31, and the longitudinal sealing mechanism 32. The transverse sealing mechanism 33 comprises a left-right symmetrical pair of sealing jaws 330, as shown in FIG. 5. The two sealing jaws 330 revolve in approximate D shapes while describing mutually symmetric trajectories T, and press together when transversely sealing the tubular film Fmc.

In addition, a cutter (not shown) is built into the transverse sealing mechanism 33. The cutter cuts off and separates the product B and the following tubular film Fmc at the center position of the portion sealed by the sealing jaws 330.

Furthermore, the transverse sealing mechanism 33 crimps the portion to be transversely sealed by interposing the tubular film Fmc between the sealing jaws 330, but heat is necessary in addition to pressure in order to perform the sealing. Consequently, in order for the contact surfaces of the sealing jaws 330 that contact the tubular film Fmc to apply heat, a thermocouple thermometer with a built-in heater is attached to each sealing jaw 330.

Immediately before the sealing jaws 330 of the transverse sealing mechanism 33 transversely seal the tubular film Fmc, the pair of ironing parts 34 interpose from both sides and iron the portion of the tubular film Fmc to be transversely sealed by the sealing jaws 330 of the transverse sealing mechanism 33 (hereinbelow, referred to as the transverse seal portion), and the vicinity thereof. Each ironing part 34 is arranged below a sealing jaw 330, and both ironing parts 34 revolve in an approximate D shape while describing mutually symmetric trajectories T, the same as the two sealing jaws 330 of the transverse sealing mechanism 33. The drive for this revolving motion serves double duty as the drive for the transverse sealing mechanism 33.

As shown in FIG. 2, the discharge chute 35 is provided below the transverse sealing mechanism 33, and guides the product B cut and separated from the following tubular film Fmc by means of the cutter of the transverse sealing mechanism 33 onto a belt conveyor (not shown) that transports the product B to the downstream process. This discharge chute 35 is something like a slide made from a metal plate and the like, and uses gravity to guide the bag to the belt conveyor.

The gas supply unit 5 is an apparatus that feeds an inert gas, such as nitrogen or argon, to the gas passageway 303 of the former 30, and supplies the gas to the tubular film Fmc. As shown in FIG. 4, the gas supply unit 5 comprises a regulator 50, a flow meter 51, a connector 52, and hoses and the like that connect each of the parts.

The regulator 50 is an apparatus that is connected to a gas cylinder filled with the gas, reduces the pressure of the gas that discharges from the gas cylinder, and adjusts that pressure to a constant pressure. The gas depressurized by the regulator is then sent to the connector 52. The flow meter 51 is provided between the regulator 50 and the connector 52, and enables the operator and the like of the vertical bag manufacturing and packaging apparatus 1 to view the flow rate of the gas sent to the connector 52. The connector 52 is connected to the cooling unit 6, discussed later, the gas supply unit 5, and the former 30. In addition, the gas that was sent from the gas cylinder is first sent to the cooling unit 6, and the gas that returns cooled is then sent to the former 30.

The cooling unit 6 cools the gas sent to the tubular film Fmc via the gas passageway 303 of the former 30. The cooling unit 6 cools the gas sent from the gas cylinder via the connector 52 to a temperature lower than the outside air, and then sends it once again to the gas passageway 303 of the former 30 via the connector 52. In addition, the cooling unit 6 is provided with an adjustment knob 60, and the cooling temperature of the gas can be adjusted by manually rotating the adjustment knob 60. Furthermore, the connector 52 has a dual structure; the gas before cooling and the gas after cooling are divided and respectively sent to separate passageways.

Figure 6:
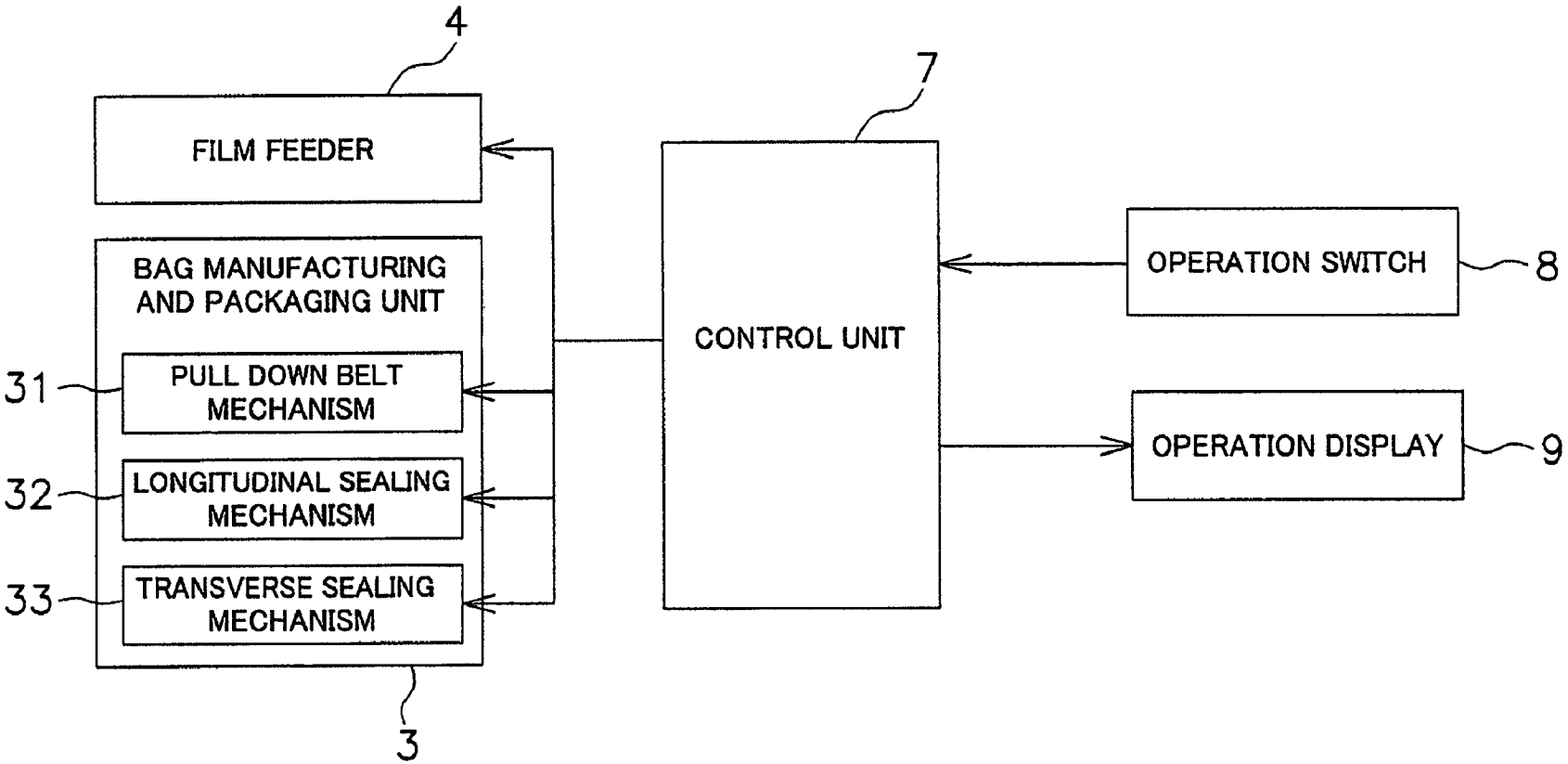
FIG. 6 is a control block diagram.

As shown in FIG. 6, the control unit 7 is connected to the film feeder 4 and the bag manufacturing and packaging unit 3 of the vertical bag manufacturing and packaging apparatus 1, and controls the operation of all the drive units.

The control unit 7 controls the revolve speed of the sealing jaws 330 and the ironing parts 34 of the transverse sealing mechanism 33, and the operation of pressing the sealing jaws 330 against the tubular film Fmc, in accordance with the downward feed speed of the tubular film Fmc by the pull down belt mechanisms 31. In addition, the control unit 7 controls the operation of each drive unit of the vertical bag manufacturing and packaging apparatus 1 based on the content inputted from an operation switch 8 (refer to FIG. 1), and displays various information on a liquid crystal display 9 (refer to FIG. 1).

Operation

The following explains an overview of the operation of the vertical bag manufacturing and packaging apparatus 1, based principally on FIG. 2.

The sheet film F sent from the film feeder 4 to the former 30 is tubularly formed by wrapping it around the tube 300 from the shoulder 301, and is then transported downward as is by the pull down belt mechanisms 31. Further, the film F transits to a state wherein both end parts overlap on the circumferential surface in a state wrapped around the tube 300, and that overlapped portion is longitudinally sealed by the longitudinal sealing mechanism 32.

The tubular film Fmc that has been longitudinally sealed and cylindrically shaped comes off the tube 300 and descends to the transverse sealing mechanism 33. At this time, the position of the tubular film Fmc is indicated by the double dashed chain line. In addition, simultaneously with the motion of the tubular film Fmc at this time, an aggregate of foodstuffs and the like drop down from the weighing apparatus 2 through the tube 300.

In addition, in parallel with the dropping of the foodstuffs downward, gas that has been cooled by the cooling unit 6 to a prescribed temperature is supplied to the tubular film Fmc through the gas passageway 303. The supply of the gas will be explained based on FIG. 4.

Gas discharged from the gas cylinder is sent to the regulator 50 through a hose. The gas is depressurized in the regulator 50, adjusted to a constant pressure, and sent to the connector 52 (the arrow A1 and the arrow A2). Furthermore, the operator of the vertical bag manufacturing and packaging apparatus 1 can view the flow meter 51 and adjust beforehand the flow rate of the gas sent to the connector 52. The gas is sent through the connector 52 to the cooling unit 6, and cooled (the arrow A3). Furthermore, the operator of the vertical bag manufacturing and packaging apparatus 1 can set the cooling temperature beforehand by the adjustment knob 60 of the cooling unit 6. The cooled gas is sent to the former 30 (the arrow A4), passes through the gas passageway 303 (the arrow A5), and discharged from the tip of the former 30 into the tubular film Fmc.

When the tubular film Fmc is filled with the gas, and foodstuffs and the like, the tubular film Fmc is sealed, and a bag is thereby formed. The operation at this time will be explained based on FIG. 5.

The lower end and the upper end portions of the bag are transversely sealed sequentially in the transverse sealing mechanism 33 in a state wherein the foodstuffs and the like, and the gas at a temperature lower than the outside air are present inside the tubular film Fmc. In addition, immediately before transverse sealing, ironing processing is performed that irons the portion to be tubularly transversely sealed, and the vicinity thereof. The sealing jaws 330 and the ironing parts 34 of the transverse sealing mechanism 33 revolve along approximately D shaped trajectories T. Furthermore, in the first half of a linear trajectory portion of the approximately D shaped trajectories T, the ironing parts 34 press the foodstuffs and the like downward by ironing the transverse seal portion and the portion in the vicinity thereof. In addition, in the latter half of the linear trajectory portion of the approximately D shaped trajectories T, the sealing jaws 330 interpose the transverse seal portion of the tubular film Fmc, and thermoseal the transverse seal portion by means of heat and pressure. At this time, the cutters built into the sealing jaws 330 simultaneously perform cutting processing. The cutters cut the substantially center of the transverse seal portion. Thereby, the bag is cut off from the following tubular film Fmc, and separated as the product B. The separated product B slides down the discharge chute 35 onto the belt conveyor, and is transported to an apparatus, such as a checker, in the downstream process.

The product B manufactured in this fashion is sealed with foodstuffs and the like, and gas having a temperature lower than the outside air. Consequently, the temperature of the gas inside the product B is affected by the temperature of the outside air with the passage of time, and rises, and the gas therefore expands. When the gas expands, the product B inflates, thus increasing its thickness. In so doing, a sufficiently inflated product B is manufactured.

Characteristics

In this vertical bag manufacturing and packaging apparatus 1, the thickness of the product B to be manufactured can be adjusted by adjusting the temperature of the gas cooled by the cooling unit 6. In other words, the cooled gas with which the bag is filled is affected by the temperature of the outside air, and its temperature rises. The gas whose temperature has risen expands, thereby increasing its volume. The bag filled with gas, and foodstuffs and the like is sealed, and inflates attendant with the increase in the volume of the gas. Consequently, the thickness of the product B increases. Furthermore, to further increase the thickness of the product B, gas of the same volume should be further cooled to a lower temperature, and the bag then should be sealed; if it is desired to suppress an increase in the thickness of the product B, then the cooling temperature of the gas should conversely be restricted. Thus, by adjusting the cooling temperature of the gas when filling the tubular film Fmc, the vertical bag manufacturing and packaging apparatus 1 can adjust the amount of change in the volume of the gas after the bag is filled, and therefore can adjust the thickness of the product B.

If ironing processing is performed wherein the transverse seal portion of the tubular film Fmc is ironed immediately before transverse sealing, then it is possible to prevent foodstuffs and the like from being sandwiched in the seal portion, producing a defective product. However, if such ironing processing is performed, then, in a conventional packaging apparatus, the gas unfortunately escapes from between the transverse seal portion and the ironing parts 34, making it difficult to manufacture a sufficiently inflated product B. However, according to this vertical bag manufacturing and packaging apparatus 1, the cooled gas expands after the product B is manufactured and the product B can thereby be inflated, even if a portion of the gas escapes during the ironing processing. Thus, this vertical bag manufacturing and packaging apparatus 1 can manufacture a sufficiently inflated product B while preventing foodstuffs and the like from being caught by the ironing processing.

This vertical bag manufacturing and packaging apparatus 1 can adjust the thickness of the product B just by passing the gas sent to the tubular film Fmc through the cooling unit 6. Accordingly, the thickness of the product B can be adjusted by a simple configuration for cooling the gas. For example, compared with the case wherein a mechanism is provided for removing gas, such as the air bleeder plate in the packaging apparatus disclosed in Japanese Published Patent Application No. Hei 11-171110, such a mechanism is not needed, and the thickness can be adjusted with a simple configuration for adjusting the temperature. In addition, compared with the case wherein the injection of gas is divided into an initial injection of a small amount and a later injection as in the packaging apparatus disclosed in Japanese Published Patent Application No. Hei 11-292019, control in the vertical bag manufacturing and packaging apparatus 1 is simple, and is accomplished just by regulating the cooling temperature of the cooling unit.

In this vertical bag manufacturing and packaging apparatus 1, the procedure for removing the gas in order to adjust the thickness of the product B is not needed, and the speed of manufacture of the product B can thereby be increased. In addition, the operating ratio can be improved along with the increased manufacturing speed of the product B. Furthermore, it is not necessary for the operator to perform the operation of removing the gas from the bag in order to adjust the thickness of the product B, and the burden on the operator can thereby be lightened.

Second Embodiment

Figure 8:
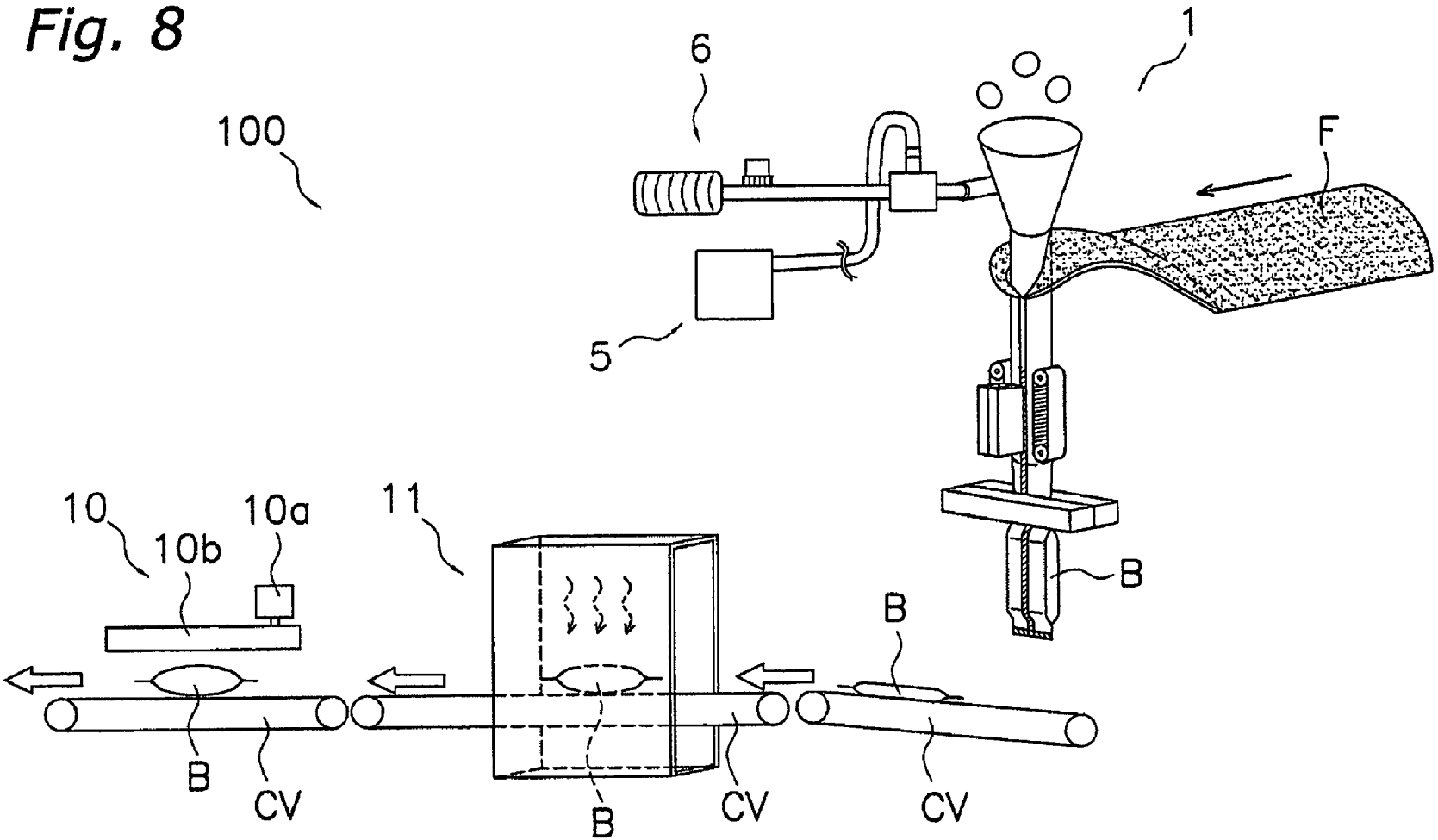
FIG. 8 is a configuration diagram that depicts the packaging system according to the second embodiment.

In addition to the constitution of the vertical bag manufacturing and packaging apparatus 1 (the packaging apparatus) described in the first embodiment, a packaging system 100 of the present embodiment comprises a thermostatic chamber 11 (the thermal application unit) and a seal checker 10 (the postprocessing apparatus), as shown in FIG. 8. Furthermore, only a portion of the constitution of the vertical bag manufacturing and packaging apparatus 1 is illustrated in FIG. 8 to facilitate understanding.

The thermostatic chamber 11 applies heat to the product B (the package) manufactured by the vertical bag manufacturing and packaging apparatus 1, the gas sealed inside the product B is expanded, thus inflating the product B. The inside of the thermostatic chamber 11 is maintained at a prescribed temperature higher than that of the external temperature. The product B is warmed by passing through the inside of the thermostatic chamber 11. Accordingly, the gas sealed inside the product B is warmed to a temperature approximately the same level as the outside air in a short time. Furthermore, instead of the thermostatic chamber 11 depicted in FIG. 8, it is also possible to adopt a hot air shower that applies heat to the product B by blowing hot air against the product B.

The seal checker 10 is a mechanism that checks whether the seal of the product B manufactured in the vertical bag manufacturing and packaging apparatus 1 is defective, and principally comprises a servomotor 10*a*, a pressing member 10*b*, and the like. The servomotor 10*a* brings the pressing member 10*b* into contact with the product B, and separates the pressing member 10*b* from the product B. The pressing member 10*b* presses the product B by the servomotor 10*a* bringing the pressing member 10*b* into contact with the product B. When the pressing member 10*b* presses the product B, the seal checker 10 detects the bag height of the product B (the thickness of the product B), and judges whether the seal is defective based on the displacement quantity of that detected value. In addition, the detection information related to the bag height of the product B detected by the seal checker 10 is sent to the control unit 7 (refer to FIG. 9) that manages the control of the vertical bag manufacturing and packaging apparatus 1 and the thermostatic chamber 11.

Figure 9:
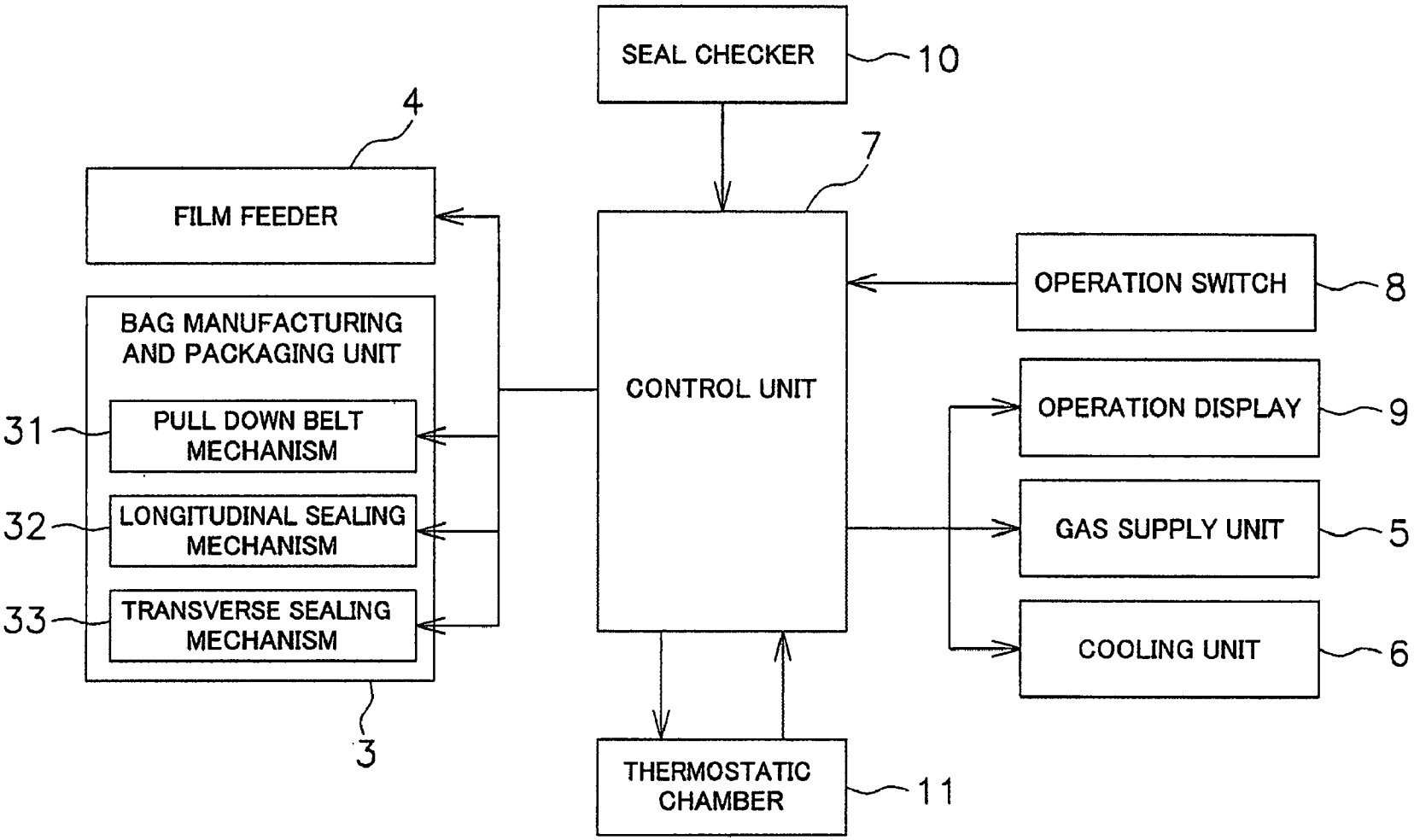
FIG. 9 is a control block diagram of the packaging system according to the second embodiment.

The control unit 7 depicted in FIG. 9 controls the cooling unit 6 and the thermostatic chamber 11 based on the detection information in the seal checker 10. In other words, taking into consideration the ease of performing the checking operation with the seal checker 10, the control unit 7 controls the cooling temperature of the gas by means of the cooling unit 6 (the gas temperature modifying unit) based on the detection information in the seal checker 10 so that the bag height of the product B is optimized. Furthermore, the cooling unit 6 is herein constituted substantially the same as the cooling unit 6 in the first embodiment, but can automatically adjust the quantity of gas by a drive mechanism, such as a motor, and can adjust the quantity of gas by the control unit 7 controlling the drive mechanism. In addition, taking into consideration the ease of the checking operation in the seal checker 10, the control unit 7 controls the thermostatic chamber 11 based on the detection information in the seal checker 10. If the hot air shower is used instead of the thermostatic chamber 11, then the control unit 7 controls the temperature of the hot air blown against the product B based on the detection information in the seal checker 10.

Furthermore, the control unit 7 may also be one wherein all of the apparatuses are provided separately and are connected by a communication line, or may be constituted by independent control units separately arranged in each apparatus and a central control unit that provides overall central control of the control unit of each of the apparatuses.

The following explains an outline of the packaging operation by the packaging system 100, based on FIG. 8.

First, the same as in the first embodiment, the product B is manufactured by the vertical bag manufacturing and packaging apparatus 1 wherein foodstuffs and the like, and gas at a temperature lower than the outside air are sealed inside a bag.

The product B separated from the following film F is discharged from the vertical bag manufacturing and packaging apparatus 1, and transported to the thermostatic chamber 11 by the belt conveyors CV. The product B transported to the thermostatic chamber 11 is heated while passing through the inside of the thermostatic chamber 11. Furthermore, heating of the product B promotes the expansion of the gas sealed in the product B. Consequently, the gas inside the product B is warmed to a temperature close to the outdoor temperature in a short time, and the product B inflates to the desired state while passing through the thermostatic chamber 11. Thereby, the appropriate product B height is obtained.

The product B discharged from the thermostatic chamber 11 is transported to the seal checker 10 by the belt conveyors CV. The seal checker 10 checks whether there is a seal defect in the product B by comparing the displacement quantity of the bag height of the product B with a standard value when the product B is pressed by the pressing member 10*b*. If the product B is a proper product, then processing is performed such as further transporting the product B, packing it in a box, and the like. Even in postprocessing like boxing, it is easy to process the product B that has passed through the thermostatic chamber 11 and is already an appropriate height.

In addition, the detection information related to the bag height of the product B detected by the seal checker 10 is transmitted to the control unit 7, and used in feedback control of the cooling unit 6 and the thermostatic chamber 11. Thereby, the temperature in the cooling unit 6 and the thermostatic chamber 11 is more appropriately controlled.

In this packaging system 100, the thermostatic chamber 11 is provided between the vertical bag manufacturing and packaging apparatus 1 and the seal checker 10, and the product B is warmed while being transported between the vertical bag manufacturing and packaging apparatus 1 and the seal checker 10. Consequently, the product B can be inflated in a short time to the desired bag height by the time it is transported to the seal checker 10. Thereby, in this packaging system 100, the product B, whose height has become appropriate, can be easily processed with comparatively few errors in the seal checker 10 and other postprocessing apparatuses after bag manufacturing and packaging processing, thereby enabling an improvement in the operating ratio of the production line of the vertical bag manufacturing and packaging apparatus 1 and the like.

Because this packaging system 100 is provided with the seal checker 10 as a postprocessing apparatus that performs postprocessing on the product B, it is possible to rapidly obtain data like the bag height of the product B in an inflated state after heat has been applied from the thermostatic chamber 11.

Furthermore, in this packaging system 100, the seal defect detection information in the seal checker 10 is sent to the control unit 7, and the control unit 7 controls the thermostatic chamber 11 and the cooling unit 6 based on this detection information. Thereby, it is possible to perform more appropriate control of the thermostatic chamber 11 and the cooling unit 6.

Other Embodiments

In the abovementioned first embodiment, the gas is cooled through the cooling unit 6 before being sent to the former 30; however, it is also acceptable to provide a mechanism that cools the gas passageway 303 of the former 30, and to cool the gas when it passes through the gas passageway 303. Furthermore, it is also acceptable to provide a mechanism that cools the shoulder 301 of the former 30, and to cool the gas when it passes through the shoulder 301.

In the abovementioned first embodiment, the gas is cooled directly by the cooling unit 6, but the gas may also be cooled indirectly. In other words, it is also acceptable to cool the gas by cooling an object that is in contact with the gas, and then transmitting the temperature of that object to the gas. For example, the gas inside the bag may be cooled by cooling the foodstuffs and the like that the bag is filled with, cooling the film F before and after tubularly forming the film F with the former 30, and so on.

In the abovementioned first embodiment, the gas is introduced inside the tubular film Fmc after being cooled; however, it is also acceptable to reverse the order of the cooling of the gas with the introduction into the tubular film Fmc. In other words, it is also acceptable to first introduce room temperature gas into the tubular film Fmc, then cool the gas for each tubular film Fmc, and subsequently seal the tubular film Fmc. Even if the product B is manufactured in this order, it is possible to manufacture the product B wherein gas having a temperature different from the outside air is sealed.

In the abovementioned first embodiment, the cooling of the gas inflates the product B; however, it is also conversely possible to shrink the product B by warming the gas. In addition, it is also possible to flexibly increase and decrease the thickness of the product B using both cooling and warming.

Figure 7:
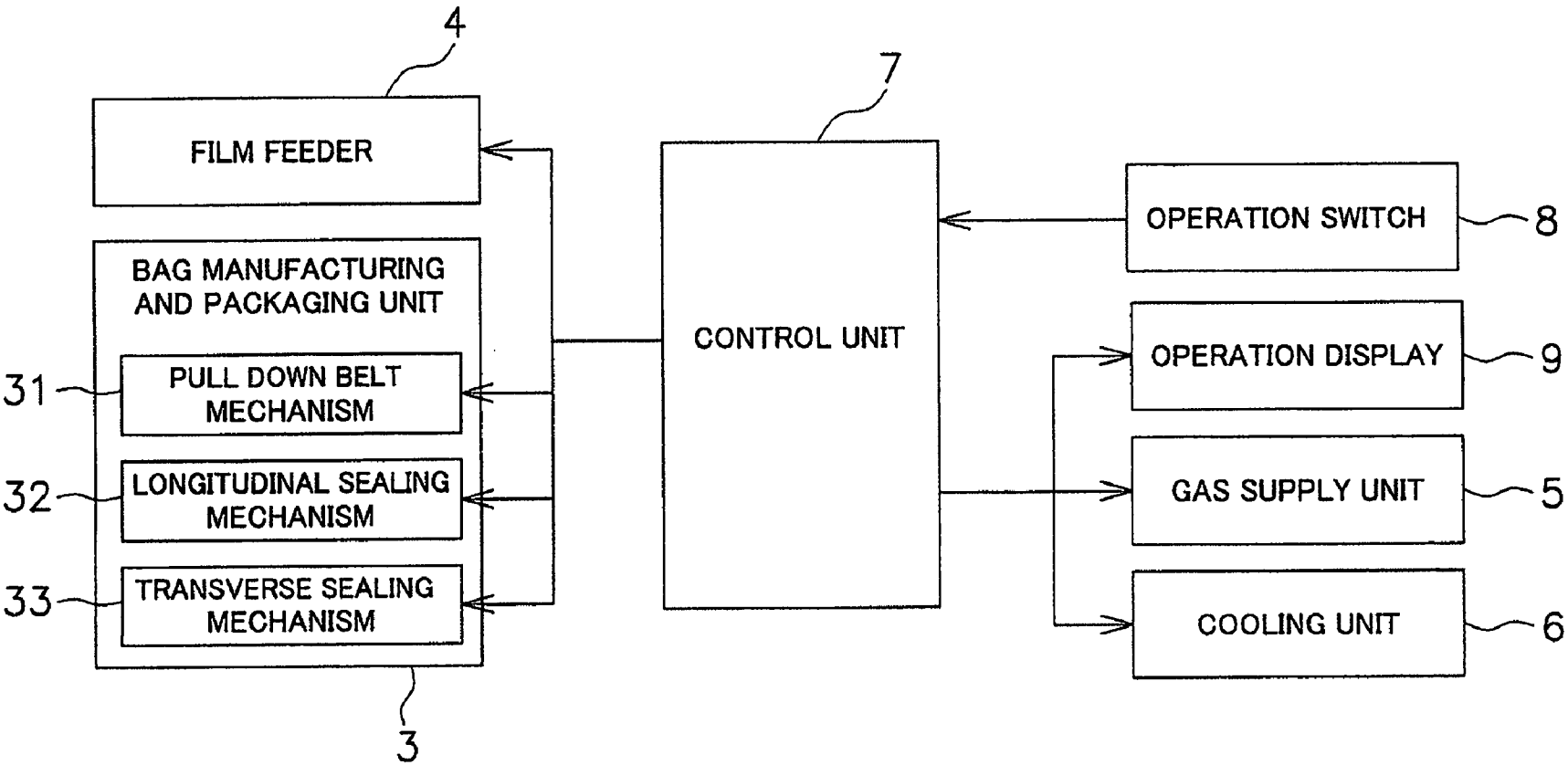
FIG. 7 is a control block diagram according to another embodiment.

In the abovementioned first embodiment, it is also acceptable for the control unit 7 to control the gas supply unit 5 and the cooling unit 6, making it possible to automatically control the temperature and the discharge amount of the gas, as shown in FIG. 7. In this case, the thickness of the product B is controlled by controlling the temperature and the discharge amount of the gas, taking into consideration the size of the bag being manufactured, the size and shape of the foodstuffs and the like that the bag is filled with, and the outside air temperature. Thereby, the thickness of the product B can be automatically controlled.

In the abovementioned first embodiment, the vertical bag manufacturing and packaging apparatus 1 utilized by the present invention packs in bags the foodstuffs and the like along with gas and the like while manufacturing the bag from the film F; however, the present invention may also be utilized in a bag feeding and packaging apparatus that supplies pre-manufactured bags, and seals those bags with foodstuffs and the like, and gas.

In the abovementioned second embodiment, the gas supply unit 5 and the cooling unit 6 are treated as a part of the vertical bag manufacturing and packaging apparatus 1; however, it is also possible to treat them as outside of the vertical bag manufacturing and packaging apparatus 1 or separate from the vertical bag manufacturing and packaging apparatus 1 if there is a cooled gas supply apparatus (gas supply unit 5, cooling unit 6).

If the packaging apparatus and the packaging method according to the present invention are used, then it is possible to adjust the thickness of a package with a simple configuration.

The invention claimed is:

1. A packaging apparatus that manufactures a package wherein foodstuff article to be packaged and an inert gas are sealed in a packaging material, comprising:

an introducing unit through which the article to be packaged and the gas are supplied to the packaging material formed in a tubular shape;

a first sealing mechanism that seals the tubular packaging material to manufacture a package containing the article and the gas; and a control unit that is configured to adjust the temperature and amount of the gas in the sealed package so that a prescribed thickness of the sealed package is achieved based upon the difference between the temperature of the outside air and the temperature of the gas by setting the temperature of the gas in the packaging material at a temperature lower than that of the outside air when said first sealing mechanism seals the tubular package material, the control unit being further configured to receive postprocessing information relating to a state of the package after the package is manufactured by the packaging apparatus and to perform a feedback control of the temperature of the gas in a subsequently manufactured package based on the postprocessing information.

2. The packaging apparatus as recited in claim 1, comprising:

a gas temperature modifying unit that changes a temperature of a gas.

3. The packaging apparatus as recited in claim 2, wherein the gas temperature modifying unit changes the temperature of the gas by changing the temperature of the article to be packaged.

4. The packaging apparatus as recited in claim 2, wherein the gas temperature modifying unit changes the temperature of the gas by changing the temperature of the packaging material.

5. The packaging apparatus as recited in claim 2, wherein the gas temperature modifying unit changes the temperature of the gas by changing the temperature of said introducing unit.

6. The packaging apparatus as recited in claim 1, comprising:

a forming unit that tubularly forms the packaging material; and a gas temperature modifying unit that changes the temperature of the gas by changing the temperature of said forming unit.

7. The packaging apparatus as recited in claim 1, further comprising:

a pair of smoothing parts that smoothes a portion of the packaging material to be sealed, and a vicinity thereof.

8. The packaging apparatus as recited in claim 1, further comprising:

a transporting unit that transports the tubular packaging material downward; and a second sealing unit tat seals a longitudinal edge of the tubular packaging material, the longitudinal edge being parallel to the transport direction of the transported flexible packaging material, the direction in which the first sealing mechanism seals the tubular packaging material is perpendicular to the transport direction.

9. A packaging method for manufacturing a package wherein a food stuff article to be packaged and an inert gas are sealed in a packaging material, comprising steps of:

providing a tubular packaging material;

supplying the article to be packaged in the tubular packaging material;

supplying the gas in the tubular packaging material;

sealing the tubular packaging material to manufacture a package containing the article and the gas;

adjusting a temperature and an amount of the gas supplied to the package before or after the supplying of the gas in the tubular packaging material so that a prescribed thickness of the sealed package is achieved based upon the difference between the temperature of the outside air and the temperature of the gas;

setting the temperature of the gas in the packaging material at a temperature lower than that of the outside air when the gas and the article to be packaged are sealed;

receiving postprocessing information relating to a state of the package after the package is manufactured; and performing a feedback control of the temperature of the gas in a subsequently manufactured package based on the postprocessing information received.

10. A packaging system, comprising:

a packaging apparatus that manufactures a package wherein a foodstuff article to be packaged and an inert gas are sealed in a packaging material, the packaging apparatus including an introducing unit through which the article to be packaged and the gas are supplied to the packaging material formed in a tubular shape; and a first sealing mechanism that seals the tubular packaging material to produce a package containing the article and the gas;

a gas temperature modifying unit that adjusts the temperature and amount of the gas supplied to the package before the gas is sealed in the package so that a prescribed thickness of the sealed package is achieved based upon the difference between the temperature of the outside air and the temperature of the gas;

a postprocessing checking apparatus that performs postprocessing checking of the package; and a control unit that is configured to set the temperature of the gas at a temperature lower than that of the outside air when the gas and the article to be packaged are sealed and to perform a feedback control of said gas temperature modifying unit based on detection information produced by said postprocessing checking apparatus.

11. The packaging system as recited in claim 10, further comprising:

a thermal application unit that performs thermal application processing on the manufactured package.

12. The packaging system as recited in claim 11, wherein said thermal application unit has a thermostatic chamber that warms the package.

13. The packaging system as recited in claim 11, wherein said thermal application unit blows hot air onto the package.

14. The packaging system as recited in claim 10, wherein the control unit is further configured to control said thermal application unit based on detection information produced by said postprocessing checking apparatus.

15. A packaging apparatus that manufactures a package wherein foodstuff article to be packaged and an inert gas are sealed in a packaging material, comprising:

an introducing unit through which the article to be packaged and the gas are supplied to the packaging material formed in a tubular shape;

a first sealing mechanism that seats the tubular packaging material to manufacture a package containing the article and the gas;

an outside air temperature acquisition unit that detects the temperature of the air outside the sealed package; and an adjustment unit that sets the temperature of the gas based upon the outside air temperature detected by the outside air temperature acquisition unit, and sets the amount of the gas supplied to the package so that a prescribed thickness of the sealed package is achieved based upon the difference between the temperature of the outside air and the temperature of the gas, the adjustment unit further receives postprocessing information relating to a state of the package after the package is manufactured and performs a feedback control of the temperature of the gas in a subsequently manufactured package based on the postprocessing information.

* * * * *